US006662735B2

(12) United States Patent
Tischer et al.

(10) Patent No.: US 6,662,735 B2
(45) Date of Patent: Dec. 16, 2003

(54) REACTOR AND METHOD FOR GASIFYING AND/OR MELTING MATERIALS

(75) Inventors: Eckhardt Tischer, Zella/Rhön (DE); Frank Wuchert, Kaltenwestheim (DE)

(73) Assignee: Maschinen- und Stahlbau GmbH, Unterkatz (DE)

( * ) Notice: Subject to any disclaimer, the term of this patent is extended or adjusted under 35 U.S.C. 154(b) by 0 days.

(21) Appl. No.: 10/203,525

(22) PCT Filed: Feb. 13, 2001

(86) PCT No.: PCT/EP01/01581

§ 371 (c)(1),
(2), (4) Date: Aug. 9, 2002

(87) PCT Pub. No.: WO01/61246

PCT Pub. Date: Aug. 23, 2001

(65) Prior Publication Data

US 2003/0010267 A1 Jan. 16, 2003

(30) Foreign Application Priority Data

Feb. 17, 2000 (DE) ..... 100 07 115

(51) Int. Cl.[7] ..... F23B 7/00; F23G 5/04; F23G 5/10

(52) U.S. Cl. ..... 110/342; 110/346; 110/345; 110/229; 110/224; 110/225; 110/230; 110/250

(58) Field of Search ..... 422/143; 110/224, 110/225, 229, 230, 231, 250, 259, 341, 342, 345, 346; 48/76, 77, 111; 219/443.1

(56) References Cited

U.S. PATENT DOCUMENTS

| | | | | | |
|---|---|---|---|---|---|
| 3,985,518 | A | * | 10/1976 | Anderson | 48/111 |
| 4,048,927 | A | | 9/1977 | Augustin | |
| 4,076,504 | A | * | 2/1978 | Oshida et al. | 23/277 C |
| 4,156,394 | A | | 5/1979 | Mallek et al. | |
| 4,213,404 | A | * | 7/1980 | Spaulding | 110/229 |
| 4,643,110 | A | * | 2/1987 | Lisowyj et al. | 110/229 |
| 4,776,285 | A | * | 10/1988 | Wallner et al. | 110/229 |
| 4,797,142 | A | * | 1/1989 | Jensen | 65/2 |
| 4,822,573 | A | * | 4/1989 | Timmann | 422/143 |
| 4,831,944 | A | * | 5/1989 | Durand et al. | 110/346 |
| 5,054,405 | A | * | 10/1991 | Walker | 110/254 |
| 5,095,829 | A | * | 3/1992 | Nevels | 110/346 |
| 5,318,602 | A | * | 6/1994 | Juch | 48/76 |
| 5,401,166 | A | | 3/1995 | Mallek et al. | |
| 5,782,032 | A | * | 7/1998 | Tanaka et al. | 48/77 |
| 5,901,653 | A | * | 5/1999 | Jennebach et al. | 110/213 |
| 6,021,723 | A | * | 2/2000 | Vallomy | 110/203 |
| 6,030,432 | A | * | 2/2000 | Kepplinger et al. | 75/451 |

FOREIGN PATENT DOCUMENTS

| | | | | |
|---|---|---|---|---|
| DE | EP0446888 A2 | * | 9/1991 | F23G/5/00 |
| DE | 19816864 A1 | * | 10/1991 | F27B/1/10 |
| DE | 4317145 C1 | * | 4/1994 | F23G/5/027 |
| DE | 19640497 C2 | * | 4/1994 | F27D/1/08 |
| DE | 198 16 864 | | 10/1999 | |
| EP | 257 019 | | 2/1988 | |
| GB | 456 111 | | 11/1936 | |

* cited by examiner

*Primary Examiner*—Henry Bennett
*Assistant Examiner*—K. B. Rinehart
(74) *Attorney, Agent, or Firm*—Ostrolenk, Faber, Gerb & Soffen, LLP

(57) ABSTRACT

A reactor for gasifying and/or melting feed materials, the reactor including a charging section with a feed opening, through which the feed materials are charged to the reactor from above and a pyrolysis section which has an expanded cross section and is located below the charging section so that a discharge cone of the feed material can form. Gas supply devices, open into the pyrolysis section substantially at a level of the expanded cross section and through which hot gases can be fed to the discharge cone. A melting and superheating section is located below the pyrolysis section and has a narrowing cross section. Upper injection devices are arranged so that an energy-rich medium is supplyable to the melting and superheating section immediately below a level of the narrowing section. A reduction section is located below the melting and superheating section. The reduction section has gas exhaust devices through which excess gases are exhausted. A hearth is provided with a tap below the reduction section for accumulating and draining molten metal and molten slag. Lower injection devices are provided through which an energy-rich medium is supplyable directly above the molten metal and slag and below the gas exhaust devices so as to prevent solidification of the molten metal and slag.

24 Claims, 1 Drawing Sheet

REACTOR AND METHOD FOR GASIFYING AND/OR MELTING MATERIALS

This is a U.S. national stage of application No. PCT/EP01/01581, filed on Feb. 13, 2001. Priority is claimed on that application and on the following application: Country: Germany, Application No. 100 07 115.5, Filed: Feb. 17, 2000.

The invention concerns a reactor and a process for gasifying and/or melting materials. In particular, the invention concerns the material and/or energetic utilization of any type of refuse, e.g., with principally organic constituents, but also such utilization of special waste. However, the reactor and process of the invention are also well suited for the gasification and melting of feed materials of any composition as well as for the production of energy by the use of organic substances.

Solutions to the problem of thermal disposal of various types of waste and other materials have long been sought. In addition to combustion processes, various gasification processes are known, which are aimed chiefly at achieving results with the least possible impact of hazardous substances on the environment and at reducing both the expense associated with the treatment of the feed materials and the gases that arise in the process. However, the previously known processes are characterized by an expensive technology that is difficult to manage and by the associated high disposal costs for the feed material or refuse to be treated.

DE 43 17 145 C1 describes a process based on the principle of degasification for the disposal of variously composed waste materials. In the cited process, dust-containing gases that arise are completely drawn off as circulating gas and then burned with oxygen in the melting and superheating zone. However, as tests have shown, this circulation of the gas and the likewise described exhausting of the excess gas between the circulating gas exhaust port and the likewise described exhausting of the excess gas between the circulating gas exhaust port and the melting and superheating zone do not lead to the stated goal of obtaining an excess gas that contains only very few pollutants. If the circulating gas cupola also described in the cited document is used to carry out the process, then, among other problems, the pollutant load of the excess gas is so great that the gas management this necessitates for cleaning the excess gas becomes so expensive that economical disposal of the given waste materials is no longer possible.

DE 196 40 497 C2 describes a coke-fired circulating-gas cupola for the ultilization of waste materials. This circulating-gas cupola is characterized by the fact that an additional gas vent is located below the charging hopper. The pyrolysis gases drawn off at this point are returned by a circulating-gas line to the lower section of the furnace, in which combustion of the gases occurs. Since the discharge zone for the excess gases is located above the hot zone, not only excess gases, but also a large fraction of pyrolysis gases are exhausted, so that the gas mixture also contains hydrocarbons that are difficult to remove. The subsequent gas management thus becomes extremely expensive, and the environmental load increases.

DE 198 16 864 A1, on the other hand, describes a coke-fired circulating-gas cupola, in which the excess gas exhaust system is located below the melting and superheating zone. Although the quality of the excess gases can be increased in this way, since the discharged gases are greatly reduced as they flow through the superheating zone, the spatial proximity of the superheating zone results in very hot excess gases, which must then be cooled at considerable expense. Another problem is that this configuration causes slags and dusts to start to sinter in downstream parts of the discharge-side gas line. On the other hand, the temperatures in the hearth region below the gas discharge are no longer sufficiently high to maintain the molten metals and molten slags present in this region in a molten state under various charging conditions. This interferes with or entirely prevents the tapping which must be performed.

The prior-art solutions cited above are all based on the basic principle of recirculation of a partial stream of the gases that are formed, such that the gases are drawn off in the upper region of the furnace and returned to the lower region of the furnace. The engineering world has been proceeding on the assumption that this gas circulation is also necessary for heating the feed column through use of the countercurrent principle. However, the circulating-gas principle brings the following disadvantages with it: The gases rising in the shaft furnace cool off in the feed column, so that condensation phenomena of pyrolysis products in the gas withdrawal zones, in the circulating gas lines, and in the gas jet compressors needed for returning the circulating gas lead to problems that interfere with the function of the circulating-gas furnace. During the withdrawal of the circulating gas in the prior-art processes, dust particles and small particles of refuse material are necessarily withdrawn at the same time, which, together with the condensed pyrolysis products, lead to deposits that are difficult to remove inside the entire circulating gas distribution system. Furthermore, the feed column can be heated at only a relatively slow rate by the ascending circulating gas, so that, especially in the gasification of waste materials that contain large amounts of plastics, pieces of waste material adhere to the wall of the shaft and can ultimately lead to total obstruction of the furnace.

One of the goals of the present invention is thus to develop an improved reactor and a process for gasifying and melting feed materials, which avoid the disadvantages of prior-art reactors and processes. One specific goal is to achieve simple, inexpensive, and environmentally friendly material utilization and/or energetic utilization of refuse. We would especially like to enhance the functional reliability of this type of reactor by largely avoiding the operational problems associated with the circulating-gas system. Another goal of the invention is the significant reduction of the pollutant load of the excess gas to be discharged, so that the amount of work that needs to be done in a subsequent gas purification stage can be minimized.

Pursuant to these goals, and others which will become apparent hereafter, one aspect of the present invention resides in a reactor having a charge section with a feed opening through which the feed materials are charged to the reactor from above. A pyrolysis section which has an expanded cross section is located below the charging section so that a discharge cone of the feed material can form. Gas supply devices open into the pyrolysis section substantially at a level of the expanded cross section so that hot gases can be fed to the discharge cone. A melting and superheating section is located below the pyrolysis section and has a narrowing cross section. Upper injection devices are arranged immediately below a level of the narrowing of the cross section for supplying energy-rich medium to the melting and superheating section. A reduction section is located below the melting and superheating section and has gas exhaust devices through which excess gases are exhausted. A hearth is provided with a tap below the reduction section for accumulating and draining molten metal and molten slag. Lower injection devices are provided so that energy-rich medium is supplyable directly above the molten metal and slag and below the gas exhaust devices so as to prevent solidification of the molten metal and slag. In accordance with the invention, the principle of the circulating-gas process, which has long been applied in prior-art solutions, is abandoned, and instead a shaft furnace, which operates on the countercurrent principle, is used as the reactor. By completely abandoning the conventional circulating-gas system, all of the associated problems of condensation of pyrolysis products and the formation of undesirable deposits are completely avoided. In addition, partial conglomeration of the feed materials already starts to occur in the upper part of the reactor due to the shock-like heating of the feed column, so that adherence to the inside wall of the reactor is largely eliminated. The double injection of oxygen and fuel gas (gas mixtures) allows, on the one hand, the combustion of the pyrolysis gases and, on the other hand, maintenance of a sufficiently high temperature in the lower section of the reactor, so that the molten material that collects there is kept liquid. Between the two injection devices, a reduction section is formed, through which all gases must flow before they are exhausted and in which they are therefore largely reduced.

In one embodiment of the invention, which is especially suitable for the gasification of refuse, the charging section is followed by a preliminary heat-treatment section, in which the refuse is predried, e.g., at temperatures of about 100° C. In modifications of this embodiment, it is also possible to cool the feed materials in this section under certain circumstances in which this would be advantageous to the overall process.

One advantageous embodiment of the reactor is characterized by the fact that the total length of the charging section and the preliminary heat-treatment section is several times greater than the diameter of the charging section. This configuration causes the feed column in the charging and preliminary heat-treatment section to act as a plug that blocks the system from above and prevents excessive amounts of outside air from being drawn into the reactor.

In one modified embodiment, the upper end of the reactor is closed by a lock, a double flap valve system, or a similar device. In this way, the uncontrolled entrance of outside air and the escape of gases from the charge is avoided to an even greater extent.

It is advantageous for the reactor to have an essentially cylindrical design, and the gas feed chamber and the gas exhaust chamber have an annular design, so that the feeding and exhausting of the gas each occurs along the entire circumference of the feed column. This embodiment is suited specifically for utilization of primarily organic feed materials. Other embodiments that are more effective, for example, for other feed materials, may have noncylindrical basic shapes and devices for feeding and exhausting gases that are differently shaped and positioned.

It is especially advantageous if the pyrolysis section of the reactor is also designed with a double wall, and a heat-exchange medium is circulated in the space between the walls. On the one hand, the wall can be cooled in this way to reduce the stress on the wall material, and, on the other hand, depending on the feed material charged to the reactor and the resulting heat consumption of the feed column, additional heat can be supplied to or removed from the feed column, if necessary.

The above-stated goals of the invention are also achieved by the process for gasifying and/or melting feed materials which includes the steps of forming a feed column that is largely shielded from outside in a shaft-like reactor, shock-like heating the feed column by supplying hot gases in an upper region of the reactor to initiate pyrolysis in the feed materials, producing a hot zone at a lower level in the reactor with temperatures above 1,000° C. by supplying energy-rich media, combusting the pyrolysis products, melting any metallic and mineral constituents that may be present, and extensive coking of residual matter of the feed materials in the hot zone, drawing all gases downward from the feed column through the hot zone and through a reduction zone located below the hot zone, drawing off reduced excess gases from the reactor in a region of the reduction zone, accumulating any molten metal and/or molten slag in a lower most section of the reactor, introducing energy-rich media directly above the accumulated molten material to maintain it in a molten state, and tapping the molten material as necessary. The process is especially suitable for the material utilization and/or energetic utilization of refuse and other feed materials.

The essential process steps of the invention can be advantageously refined by predrying the feed material by heating the feed column to about 100° C. above the level in the reactor at which the shock-like heating occurs. This causes the water content of the feed material to be largely evaporated, which also improves the desired automatic downward movement of the feed batch. In a modified variation of the process, the feed material is not predried or may even be cooled; in the case of hot feed materials, cooling may be useful in preventing the feed material from adhering to the wall of the charging section.

It is also especially advantageous to be able to control the underpressure for exhausting the excess gases. The gases should be drawn off in such a way that, on the one hand, no gas escapes through the top of the reactor and, on the other hand, only minimal amounts of additional outside air are drawn in through the feed column. This minimization of the amount of infiltrated air present in the reactor is intended to reduce the proportion of nitrogen oxides in the excess gas and also to keep the total amount of gas low, so that the subsequent gas management can be simply designed.

In the following discussion of preferred embodiments of the invention, additional advantages, details and modifications are described with reference to the attached drawing.

BRIEF DESCRIPTION OF THE DRAWINGS

The drawing in FIG. 1 shows a simplified sectional view of a reactor in accordance with the invention.

DETAILED DESCRIPTION OF THE PREFERRED EMBODIMENTS

Figure 1:
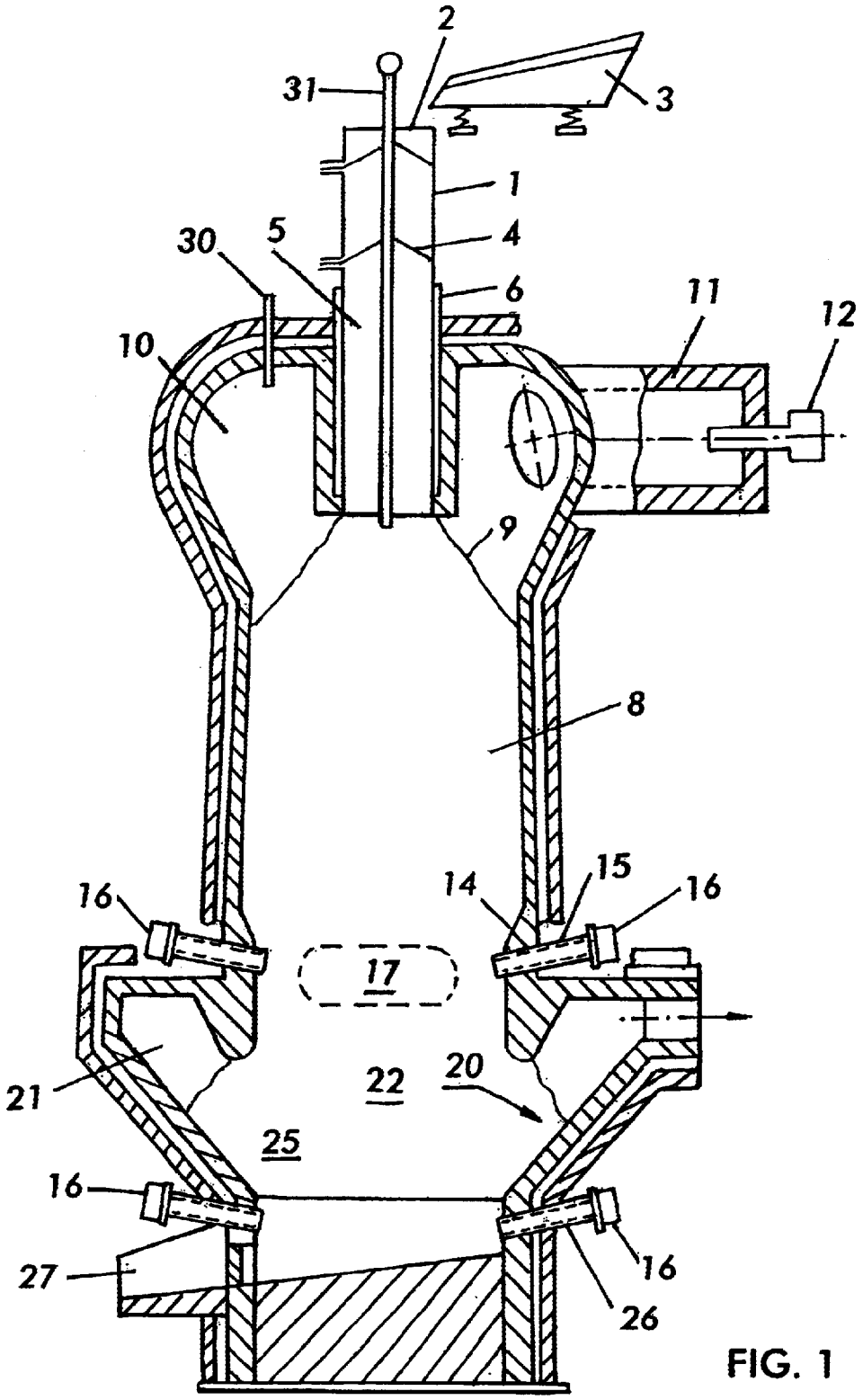

A preferred embodiment of the invention will now be described with reference to FIG. 1. In connection with the explanation of the details of the reactor, we will also describe the process steps that occur in this reactor in the treatment of feed materials that consist of refuse that contains organic material. However, the process of the invention does not necessarily have to be carried out in the reactor described here, but rather may possibly be carried out with the use of altered systems. If other feed materials are charged, modifications of the reactor and/or the process may be useful (e.g., flexible configuration and design of the technical features of the gas supply and exhaust systems, the heating or cooling of the reactor jacket, or the like). In general, different feed materials may be combined, for example, feed materials with a higher energy value (e.g., organic waste, old load-bearing wood, or the like) may be added during the gasification/melting of nonorganic feed materials.

The upper end of the reactor shown in the drawing has a charging section 1 with at least one feed opening 2 for charging the feed material that is to be processed for material utilization and/or energetic utilization. The feed material preferably consists predominantly of organic material. Therefore, the reactor and the process described here are suitable chiefly for the treatment of ordinary household trash and commercial trash of a type similar to household trash. If, in the case of certain compositions of the feed material, the combustible components are not sufficiently high to carry out the combustion and gasification processes, combustible materials or energy sources can be added to the feed material. In this connection, it is possible to add a certain amount of coke, as is done in conventional processes, or to increase the total fuel value by adding wood. Under certain circumstances, it may also be useful to add other supplementary substances, for example, in order to affect the pH that becomes established. Since experts in this field are already familiar with measures of this sort, there is no need to give detailed explanations here.

The feed material and possibly the additive materials are fed into the reactor through the feed opening 2 by suitable conveyance equipment 3. A feed column 4 is formed in this way. The level of the feed column 4 is monitored by level-measuring instruments that are not specifically shown here. The feed level should be maintained between a minimum and a maximum level. The minimum level is selected in such a way that the feed column 4 acts as a barrier layer in the upper section of the reactor to prevent large amounts of outside air from entering the reactor.

The charging section 1 is followed below by a preliminary heat-treatment (predrying) section 5, which, in this example, is used to predry the feed materials. The charging section and the preliminary heat-treatment section are advantageously designed to be cylindrical or conical with a slight increase in cross section towards the bottom. The preliminary heat-treatment section 5 has a double wall with a space 6 between the walls, in which a heat-exchange medium is circulated. Heat can be supplied by the heat-exchange medium to the feed column in the region of the double-walled predrying section 5, so that the feed material is preheated or predried. It is possible to dispense with the space between the walls, and to supply heat, for example, by heat conduction directly from the hotter zones of the reactor. The amount of heat to be supplied is calculated in such a way that the adherence of a certain amount of feed material to the wall is largely prevented. In addition, water present in the feed material is driven off by the predrying, so that it does not cause additional interference with the rest of the gasification process. In the preliminary heat-treatment section 5, the feed column 4 may be brought to a temperature of about 100° C.

The preliminary heat-treatment section 5 can possibly be completely eliminated, if predrying is unnecessary on the basis of the composition of the feed material, or the preliminary heat-treatment section may be used to cool feed materials in special cases.

The preliminary heat-treatment section 5 is followed below by a pyrolysis section 8. At the transition between the preliminary heat-treatment section (or the charging section, if the preliminary heat-treatment section has been eliminated) and the pyrolysis section, there is a sudden increase in the cross section of the reactor. The free cross section of the shaft preferably at least doubles in this transition region. This reduces the rate of descent of the feed materials and causes the formation of a discharge cone 9. The discharge cone 9 is fed centrally from the feed column in the predrying section. The discharge cone flattens out at the margins, so that a free space forms there. Gas supply devices 10 are located in this upper marginal region of the pyrolysis section 8. In the example shown here, they are designed as an annular gas supply chamber 10, which opens into the pyrolysis section 8 approximately at the level of the expanded cross section. The purpose of the gas supply chamber 10 is to feed hot gases to the discharge cone 9. The gas supply devices may also be designed as jets, openings in the wall, or other devices that make it possible to supply hot gases to the feed column. To this end, in the example shown here, at least one combustion chamber 11, which is equipped with at least one burner 12, opens into the gas supply chamber 10. The burner 12 produces the necessary hot gas, which is preferably fed tangentially to the discharge cone 9 via the combustion chambers and the gas supply chamber. In modified embodiments, several combustion chambers or several burners may be used, if this is desirable for achieving the most uniform possible heating of the discharge cone.

The combustion in the burner 12 is suitably carried out with a deficiency of oxygen, in order to produce an inert combustion gas with temperatures of about 1,000° C. by nearly stoichiometric combustion. At least in the start-up operation, the burner will need externally supplied fuels that cannot be obtained directly from the reactor. For example, natural gas, oil, the excess gas produced in an earlier gasification operation and then stored for later use, gas mixtures, liquid-gas mixtures, dust-gas mixtures, or other media that are energetically suitable may be used. As soon as the reactor has reached its operating state, which will be described below, the burner 12 can also be operated with excess gas, which has possibly first been cleaned. The feed material present in the region of the discharge cone is subjected to shock-like heating when it is supplied with the combustion gas, which, with suitable control, consists chiefly of carbon dioxide and water vapor. The very rapid heating of the material to temperatures of 800–1,000° C. causes very rapid drying of the material, and this prevents it from adhering and bonding to the wall. Instead, at least partial conglomeration of the feed materials occurs. In addition, the process of driving off pyrolysis products is already set in motion in this upper section of the reactor. Since the gas that is supplied is largely inert, these pyrolysis products are subjected to combustion to only a slight extent, i.e., to the extent that air may be drawn in through the feed column 4 that is piled up above the discharge cone and to the extent that air is carried into the reactor with the feed material. Furthermore, due to the intense and rapid heating of the feed materials, fine dusts and small particles are quickly gasified or combusted, so that the dust treatment problems that have previously arisen in prior-art processes are avoided. Instead, dusts and particulates may now be systematically added to the feed materials in specific proportions.

The feed materials then sink lower in the pyrolysis section 8, and pyrolysis of the feed materials continues, including even the materials that are being conveyed in the center, which are likewise heated by heat transfer. The wall of the pyrolysis section is preferably thermally insulated and/or jacketed, so that, if necessary, a heat-exchange medium can be circulated through the space between the walls. The amount of thermal insulation and/or the amount of additional heat supplied by the heat-exchange medium are calculated in such a way that the feed materials in the lower region of the pyrolysis section 8 have a temperature of preferably greater than 500° C. The temperature desired in this region can be systematically adjusted to the specific feed materials.

A melting and superheating section 14 is located below the pyrolysis section 8. The cross section of the reactor narrows in this section, as a result of which there is a change in the rate of descent of the feed material. For the example of the treatment of predominantly organic refuse, the cross-sectional narrowing is at least 10%, which is produced, for example, by conical tapering of the corresponding part of the shaft at an angle of about 60° to the horizontal. In addition, the melting and superheating section 14 is equipped with upper injection devices 15, which, in the example shown here, comprise several oxygen lances 16 distributed along the circumference. The oxygen lances 16 are protected from overheating, e.g., by water cooling. In other embodiments, jets, burners, or the like are used as upper injection devices, through which the controlled supply of various fuel gases or gas compositions can be effected, with the goal of adjusting the melting and superheating zone to a desired temperature. If the supply of oxygen for this purpose is inadequate (if, for example, feed materials with a sufficiently high energy value are temporarily unavailable at this position), externally supplied fuel gases or excess gases obtained from the reactor can be supplied through the injection devices. In the specific example shown here, the upper injection devices 15 are used for the systematic and metered addition of oxygen directly below the level of the cross-sectional narrowing. This leads to the formation of a hot zone 17 in the region of the melting and superheating section 14. Temperatures of 1,500–2,000° C. preferably prevail in this hot zone 17, but the temperature must be adjusted to the given feed material.

The (inert) combustion gases supplied via the gas supply chamber 10 and the pyrolysis gases formed in the pyrolysis section 8 are drawn through this hot zone 17. The supply of oxygen in the hot zone is controlled in such a way that combustion takes place in the presence of a deficiency of oxygen, which ultimately leads to a further increase in temperature and to extensive coking of the residual substances of the feed material. The temperature in the hot zone 17 is adjusted in such a way that slag-forming mineral constituents and metallic constituents are melted. A certain amount of the hazardous substances contained in the feed material (e.g., heavy metals) is dissolved in this molten material. The molten metal and molten slag then drip down to the bottom. The residual substances, which are coked as extensively as possible, likewise sink further.

Below the melting and superheating section 14, there is a reduction section 20, in which the coked residual substances sink further after sufficient residence time. The reduction section 20 comprises a gas exhaust chamber 21 by which excess gases are exhausted. Accordingly, all of the exhausted gases must flow through both the hot zone 17 and a reduction zone 22 formed by the coked residual substances below the hot zone. The gases are reduced by the carbon present in the reduction zone 22. In particular, carbon dioxide is converted to carbon monoxide, and carbon still present in the bulk material is consumed and thus undergoes further gasification. As they pass through the reduction zone 22, the gases are also cooled, so that they can be exhausted at a technically controllable temperature, preferably about 800–1,000° C. The exhausted excess gases are subsequently fed (not shown) to cooling and/or purification stages and to suitable conveying equipment (compressor or blower). In the gasification of refuse with predominantly organic components, for example, about 80–90% of the excess gases are available as fuel gas for material and/or energetic utilization. In this regard, a partial stream of about 10–20% can be supplied as internally produced gas to the above-mentioned burner 12 and/or to the injection devices, and in this case, the cooling/purification can be limited to a minimum amount for this partial stream. Again, the gas exhaust chamber 21 advantageously (but not necessarily) has an annular design with gas-conveying equipment connected to exhaust the gases. A refractory-lined hearth 25 is located below the gas exhaust chamber 21. The molten metal and molten slag accumulate in the hearth 25. To ensure that this molten material remains liquid, lower injection devices 26 are installed directly above the molten material and below the gas exhaust chamber 21. In the example shown in the drawing, these devices once again have several oxygen lances 16 (possibly water-cooled). The lower injection devices 26 may be designed and operated in alternative ways, as was explained earlier in the case of the upper injection devices 15. By injecting a suitable amount of oxygen, gas, fuel gas, or the like, the molten material is adjusted to a sufficiently high temperature to maintain the material in a molten state. After a certain amount of molten material has accumulated, it is drained from the reactor through a tap 27. For example, temperatures of about 1,500° C. are suitable. The distribution of the total amount of oxygen/fuel gas supplied to the combustion chamber 11, the upper injection devices 15, and the lower injection devices 26 should be optimized according to the type of feed material and the other process parameters with the goal of extensive utilization of the feed material and minimization of the amount of pollutants in the residual material.

Experts will understand that, for example, for reasons of cost reduction, instead of oxygen being supplied, an oxygen/air mixture or an oxygen/fuel gas mixture may be supplied. It is also obvious that the temperature values that have been given as examples should be adjusted according to the feed materials that are to be processed and the desired processing rate. It is also clear that, under certain circumstances, in order to prevent clogging, the feed materials will have to be subjected to mechanical reduction before being charged to the reactor. Depending on the feed materials and on the desired end products, it may become necessary to add certain additional materials to the feed materials to stabilize the thermal value, to increase the yield of excess gas, and to improve slag formation, basicity, and slag flow.

If liquids are also to be reacted in the reactor, they can be advantageously fed into the reactor through a liquid injection port 30, which opens into the gas supply chamber 10 or is combined with other gas supply devices. Water, water vapor, or other liquids to be disposed of are introduced through the liquid injection port 30. This not only disposes of the liquids, but also makes it possible to control the temperature of the inert combustion gases, the pyrolysis process, and/or the composition and temperature of the excess gases.

If necessary, dusts that are to be disposed of may also be introduced into the process through a dust charging device 31. The dust charging device 31 is preferably a metering pipe that passes through the center of the charging section 1 and the preliminary heat-treatment section 5 and opens in the vicinity of the discharge cone 9. Therefore, the dusts are conveyed directly into the vicinity of the shock-like heating of the feed materials, so that they are subjected to intense heating immediately upon being discharged from the metering pipe. This produces combustion or gasification without the occurrence of explosions or the like.

Although the embodiment specifically explained above is suitable especially for the treatment (gasification and melting) of refuse with organic constituents, it will be obvious to the expert that when other types of feed materials are used, modifications of the reactor are necessary or useful. Generally speaking, special waste materials or feed materials with a relatively high metal content can also be treated; in some of these cases, the gasification principle will predominate, while in others the melting principle will predominate. It is also possible to combine different types of feed materials. To melt nonorganic feed materials, it is possible, for example, to systematically add feed materials with a higher energy value (e.g., organic refuse, old load-bearing wood, or the like).

Other modifications and refinements of the reactor of the invention and the process of the invention may arise from various specific areas of application.

What is claimed is:

1. A process for gasifying and/or melting feed materials, comprising the steps of:

forming a feed column that is largely shielded from outside in a shaft reactor;

shock heating the feed column by supplying hot gases in an upper region of the reactor to initiate pyrolysis in the feed materials;

producing a hot zone at a lower level in the reactor with temperatures above 1,000° C. by supplying energy-rich media;

combusting the pyrolysis products, melting any metallic and mineral constituents that may be present, and extensive coking of residual matter of the feed materials in the hot zone;

drawing all gases downward through the feed column, through the hot zone, and through a reduction zone located below the hot zone;

drawing off reduced excess gases from the reactor in a region of the reduction zone;

accumulating any molten metal and/or molten slag in a lowermost section of the reactor;

introducing energy-rich media directly above the accumulated molten material to maintain it in a molten state; and tapping the molten material as necessary.

2. A process in accordance with claim 1, wherein the step of producing a hot zone includes supplying one of oxygen, fuel gases, portions of the exhausted excess gas, liquid fuels, and particulate fuels as the energy-rich media.

3. A process in accordance with claim 1, and further comprising the steps of:

monitoring a reactor level so that the feed column is always maintained between a minimum level and a maximum level;

adjusting the minimum level in such a way that the feed column is shielded from the outside environment by relatively densely packed feed material above the level at which the shock heating occurs.

4. A process in accordance with claim 1, and further comprising the step of predrying the feed materials by heating the feed column to about 100° C. above a level at which the shock heating occurs.

5. A process in accordance with claim 1, and further comprising the step of controlling an underpressure for drawing off the gases, so that virtually no gases escape from a top of the reactor and only minimal amounts of additional outside air are drawn through the feed column from above.

6. A process in accordance with claim 1, and further comprising the steps of:

producing the hot gases for the shock heating of the feed column by combustion of externally supplied fuels in a start-up phase of the process; and producing the hot gases for the shock heating of the feed column by combustion of at least partially purified, reduced excess gases that are drawn off from the reactor.

7. A process in accordance with claim 6, including producing the hot gases for the shock heating of the feed column by combustion of the at least partially purified, reduced excess gases that are drawn off the reactor in combination with externally supplied fuels.

8. A process in accordance with claim 6, wherein the combusting step takes place with a deficiency of oxygen to produce an inert combustion gas that consists largely of carbon dioxide and water vapor.

9. A process in accordance with claim 1, further including feeding the excess gases that have been drawn off to a gas management system for at least one of cooling and purification.

10. A process in accordance with claim 1, and further comprising the step of adding dusts to the feed column in an immediate vicinity of the shock heating.

11. A process for gasifying and/or melting feed materials in a reactor having a charging section with a feed opening through which the feed materials are charged to the reactor from above, a pyrolysis section which has an expanded cross section and is located below the charging section so that a discharge cone of the feed material can form, gas supply devices which open into the pyrolysis section substantially at a level of the expanded cross section and through which hot gases can be fed to the discharge cone, a melting and superheating section located below the pyrolysis section and has a narrowing cross section, upper injection devices through which an energy-rich medium is supplyable to the melting and superheating section immediately below a level of the narrowing of the cross section, a reduction section located below the melting and superheating section, the reduction section having gas exhaust devices through which excess gases are exhausted, a hearth with a tap below the reduction section for accumulating and draining molten metal and molten slag, and lower injection devices through which an energy-rich medium is supplyable directly above the molten metal and slag and below the gas exhaust devices so as to prevent solidification of the molten metal and slag, the process comprising the steps of:

forming a feed column that is largely shielded from outside in the reactor;

shock heating the feed column by supplying hot gases in an upper region of the reactor to initiate pyrolysis in the feed materials;

producing a hot zone at a lower level in the reactor with temperatures above 1000° C. by supplying energy-rich media;

combusting the pyrolysis products, melting any metallic and mineral constituents that may be present, and extensive coking of residual matter of the feed materials in the hot zone;

drawing all gases downward through the feed column, through the hot zone, and through a reduction zone located below the hot zone;

drawing off reduced excess gases from the reactor in a region of the reduction zone;

accumulating any molten metal and/or molten slag in a lowermost section of the reactor;

introducing energy-rich media directly above the accumulated molten material to maintain it in a molten state; and tapping the molten material as necessary.

12. A reactor for gasifying and/or melting feed materials, comprising:

a charging section with a feed opening through which the feed materials are charged to the reactor from above;

a pyrolysis section which has an expanded cross section and is located below the charging section so that a discharge cone of the feed material can form;

gas supply devices which open into the pyrolysis section substantially at a level of the expanded cross section and through which hot gases can be fed to the discharge cone;

a melting and superheating section located below the pyrolysis section and has a narrowing cross section;

upper injection devices through which an energy-rich medium is supplyable to the melting and superheating section immediately below a level of the narrowing of the cross section;

a reduction section located below the melting and superheating section, the reduction section having gas exhaust devices through which excess gases are exhausted;

a hearth with a tap below the reduction section for accumulating and draining molten metal and molten slag; and lower injection devices through which an energy-rich medium is supplyable directly above the molten metal and slag and below the gas exhaust devices so as to prevent solidification of the molten metal and slag.

13. A reactor in accordance with claim 12, and further comprising a preliminary heat-treatment section located between the charging section and the pyrolysis section.

14. A reactor in accordance with claim 13, wherein the preliminary heat-treatment section is constructed at least partly with a jacketed wall to create a space in which a heat-exchange medium can be circulated.

15. A reactor in accordance with claim 12, gas supply devices are designed as a gas supply chamber into which at least one combustion chamber opens, the combustion chamber being equipped with at least one burner which furnishes hot gases at a temperature of about 1,000° C. to the discharge cone via the combustion chamber and the gas supply chamber.

16. A reactor in accordance with claim 13, wherein the charging section, the pyrolysis section and the reduction section are one of cylindrical and conically expanded downwardly, the charging section and the preliminary heat-treatment section have a total length at least three times greater than a diameter of an upper end of the charging section, the pyrolysis section having a cross section at least twice as great as a cross section of a lower end of the preliminary heat-treatment section.

17. A reactor in accordance with claim 16, wherein the preliminary heat-treatment section is one of cylindrical and conically expanded downwardly.

18. A reactor in accordance with claim 12, wherein the gas supply devices and the gas exhaust devices are arranged annularly around a circumference of the reactor.

19. A reactor in accordance with claim 12, wherein the pyrolysis section has a jacketed wall to create an additional space in which a heat-exchange medium is circulated.

20. A reactor in accordance with claim 12, wherein the upper injection devices comprise one of oxygen lances and jets arranged annularly around a circumference of the reactor, through which oxygen or a mixture of fuel gases is supplied.

21. A reactor in accordance with claim 12, wherein the lower injection devices comprise one of oxygen lances and jets arranged annularly around a circumference of the reactor, through which oxygen or a mixture of fuel gases is supplied.

22. A reactor in accordance with claim 12, and further comprising a liquid injection port connected to the gas supply devices.

23. A reactor in accordance with claim 12, and further comprising a dust charging device through which dusts can be supplied directly at a level of the expanded cross section between the charging section and the pyrolysis section.

24. A reactor in accordance with claim 12, and further comprising a lock mechanism arranged so that the charging section is sealed substantially gastight at an upper end by charging the feed materials through the lock mechanism.

* * * * *